US009052658B2

(12) United States Patent
Uchitani et al.

(10) Patent No.: US 9,052,658 B2
(45) **Date of Patent: *Jun. 9, 2015**

(54) FIXING DEVICE WITH A TEMPERATURE DETECTOR ADJACENT AN EASILY DEFORMABLE LOCATION AND IMAGE FORMING APPARATUS INCLUDING SAME

(71) Applicant: RICOH COMPANY, LTD., Tokyo (JP)

(72) Inventors: Takeshi Uchitani, Kanagawa (JP); Masahiko Satoh, Tokyo (JP); Masaaki Yoshikawa, Tokyo (JP); Kenji Ishii, Kanagawa (JP); Tadashi Ogawa, Tokyo (JP); Takahiro Imada, Kanagawa (JP); Hiromasa Takagi, Tokyo (JP); Kazuya Saito, Kanagawa (JP); Naoki Iwaya, Tokyo (JP); Toshihiko Shimokawa, Kanagawa (JP); Kensuke Yamaji, Kanagawa (JP); Teppei Kawata, Kanagawa (JP); Takamasa Hase, Shizuoka (JP); Takuya Seshita, Kanagawa (JP); Shuutaroh Yuasa, Kanagawa (JP); Arinobu Yoshiura, Kanagawa (JP); Hajime Gotoh, Kanagawa (JP); Akira Suzuki, Tokyo (JP); Hiroshi Yoshinaga, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/751,922

(22) Filed: Jan. 28, 2013

(65) Prior Publication Data

US 2013/0209125 A1 Aug. 15, 2013

(30) Foreign Application Priority Data

Feb. 9, 2012 (JP) ..... 2012-026030

(51) Int. Cl.
*G03G 15/20* (2006.01)

(52) U.S. Cl.
CPC ..... *G03G 15/2078* (2013.01); *G03G 15/2042* (2013.01); *G03G 2215/2035* (2013.01); *G03G 15/2039* (2013.01)

(58) Field of Classification Search
CPC ..... G03G 15/2078
USPC ..... 399/69, 329
See application file for complete search history.

(56) References Cited

U.S. PATENT DOCUMENTS 3,452,181 A * 6/1969 Stryjewski ..... 219/216
5,485,260 A * 1/1996 Mitsuya ..... 399/330

(Continued)

FOREIGN PATENT DOCUMENTS

JP 2005-092080 4/2005
JP 2007-233011 9/2007

(Continued)

*Primary Examiner* — Clayton E LaBalle
*Assistant Examiner* — Trevor J Bervik
(74) *Attorney, Agent, or Firm* — Oblon, McClelland, Maier & Neustadt, L.L.P.

(57) ABSTRACT

A fixing device for fixing an unfixed image onto a recording medium includes a fixing belt, a nip forming member, an opposing rotary member, a heater, and a temperature detector. The fixing belt is formed into a loop to move endlessly and fix the unfixed image on the recording medium. The nip forming member is disposed inside the loop formed by the fixing belt. The opposing rotary member contacts the nip forming member via the fixing belt to form a nip portion therebetween while rotating. The heater heats the fixing belt at a place other than the nip portion. The temperature detector detects a temperature of the surface of the fixing belt. The temperature detector detects the temperature near a place of the fixing belt that easily deforms as the fixing belt is heated by the heater.

9 Claims, 8 Drawing Sheets

(56) References Cited

U.S. PATENT DOCUMENTS 5,528,351 A * 6/1996 Tsuji ..... 399/322
5,832,354 A 11/1998 Kouno et al.
5,915,147 A 6/1999 Kouno et al.
7,653,338 B2 * 1/2010 Kim et al. ..... 399/330
7,783,218 B2 * 8/2010 Maeda et al. ..... 399/69
7,970,329 B2 * 6/2011 Suzuki ..... 399/329
2002/0018663 A1 2/2002 Furukawa et al.
2002/0067936 A1 6/2002 Yasui et al.
2002/0197089 A1 12/2002 Satoh
2003/0000933 A1 1/2003 Yoshinaga et al.
2003/0002894 A1 1/2003 Satoh
2003/0007813 A1 1/2003 Yasui et al.
2003/0016963 A1 1/2003 Yoshinaga et al.
2003/0206758 A1 11/2003 Yasui et al.
2003/0215271 A1 11/2003 Yoshinaga et al.
2004/0013453 A1 1/2004 Shinshi et al.
2004/0179875 A1 9/2004 Iwata et al.
2004/0213606 A1 10/2004 Satoh
2004/0245241 A1 12/2004 Kishi et al.
2004/0247332 A1 12/2004 Kishi et al.
2004/0247334 A1 12/2004 Kishi et al.
2004/0258426 A1 12/2004 Kishi et al.
2005/0025539 A1 2/2005 Yoshinaga
2005/0074251 A1 4/2005 Katoh et al.
2005/0095043 A1 5/2005 Yoshinaga et al.
2005/0123315 A1 6/2005 Kishi et al.
2005/0129432 A1 6/2005 Sato et al.
2005/0139584 A1 6/2005 Kishi et al.
2005/0163543 A1 7/2005 Satoh et al.
2005/0175368 A1 8/2005 Matsusaka et al.
2005/0175370 A1 8/2005 Matsusaka et al.
2005/0191078 A1 9/2005 Kishi et al.
2006/0029411 A1 2/2006 Ishii et al.
2006/0039713 A1 2/2006 Kishi et al.
2006/0051111 A1 3/2006 Kishi et al.
2006/0051112 A1 3/2006 Matsusaka et al.
2006/0051113 A1 3/2006 Kishi et al.
2006/0051119 A1 3/2006 Kishi et al.
2006/0051120 A1 3/2006 Kishi et al.
2006/0051121 A1 3/2006 Matsusaka et al.
2006/0116230 A1 6/2006 Satoh et al.
2006/0127118 A1 6/2006 Kishi et al.
2006/0165429 A1 7/2006 Satoh et al.
2006/0165443 A1 7/2006 Yoshinaga et al.
2006/0165448 A1 7/2006 Yoshinaga
2006/0177232 A1 8/2006 Ehara et al.
2006/0182460 A1 8/2006 Kishi et al.
2006/0210334 A1 9/2006 Tokumasu et al.
2006/0251438 A1 11/2006 Uchitani et al.
2006/0257183 A1 11/2006 Ehara et al.
2006/0285893 A1 12/2006 Ishii
2007/0014600 A1 1/2007 Ishii et al.
2007/0014603 A1 1/2007 Satoh et al.
2007/0025754 A1 2/2007 Takagi
2007/0031159 A1 2/2007 Kishi et al.
2007/0036573 A1 2/2007 Kishi et al.
2007/0059011 A1 3/2007 Seo et al.
2007/0059071 A1 3/2007 Shinshi et al.
2007/0166083 A1 7/2007 Satoh et al.
2007/0212089 A1 9/2007 Seo et al.
2007/0212090 A1 9/2007 Matsusaka et al.
2007/0218383 A1 9/2007 Seshita et al.
2007/0242988 A1 10/2007 Seo et al.
2007/0280754 A1 12/2007 Ogawa et al.
2007/0292175 A1 12/2007 Shinshi
2008/0025772 A1 1/2008 Seo et al.
2008/0025773 A1 1/2008 Ito et al.
2008/0044196 A1 2/2008 Seo et al.
2008/0063443 A1 3/2008 Yoshinaga et al.
2008/0145088 A1 6/2008 Matsusaka et al.
2008/0219721 A1 9/2008 Ito et al.
2008/0226326 A1 9/2008 Seo et al.
2008/0232873 A1 9/2008 Ueno et al.
2008/0253789 A1 10/2008 Yoshinaga et al.
2008/0317532 A1 12/2008 Ehara et al.
2009/0067902 A1 3/2009 Yoshinaga et al.
2009/0123172 A1 5/2009 Kishi et al.
2009/0123201 A1 5/2009 Ehara et al.
2009/0123202 A1 5/2009 Yoshinaga et al.
2009/0148204 A1 6/2009 Yoshinaga et al.
2009/0148205 A1 6/2009 Seo et al.
2009/0169232 A1 7/2009 Kunii et al.
2009/0245865 A1 10/2009 Shinshi et al.
2009/0245897 A1 10/2009 Seo et al.
2009/0297197 A1 12/2009 Hase
2009/0317113 A1 12/2009 Kishi et al.
2010/0008691 A1 * 1/2010 Fujiwara ..... 399/69
2010/0061753 A1 3/2010 Hase
2010/0074667 A1 3/2010 Ehara et al.
2010/0092220 A1 4/2010 Hasegawa et al.
2010/0092221 A1 4/2010 Shinshi et al.
2010/0202809 A1 8/2010 Shinshi et al.
2010/0232822 A1 9/2010 Takenaka et al.
2010/0290822 A1 11/2010 Hasegawa et al.
2010/0296828 A1 * 11/2010 Hara et al. ..... 399/69
2010/0303521 A1 12/2010 Ogawa et al.
2011/0026988 A1 2/2011 Yoshikawa et al.
2011/0044706 A1 2/2011 Iwaya et al.
2011/0044734 A1 2/2011 Shimokawa et al.
2011/0052237 A1 3/2011 Yoshikawa et al.
2011/0052245 A1 3/2011 Shinshi et al.
2011/0052277 A1 3/2011 Ueno et al.
2011/0052282 A1 3/2011 Shinshi et al.
2011/0058862 A1 3/2011 Yamaguchi et al.
2011/0058863 A1 3/2011 Shinshi et al.
2011/0058864 A1 3/2011 Fujimoto et al.
2011/0058865 A1 3/2011 Tokuda et al.
2011/0058866 A1 3/2011 Ishii et al.
2011/0064437 A1 3/2011 Yamashina et al.
2011/0064439 A1 * 3/2011 Suzuki ..... 399/69
2011/0064443 A1 3/2011 Iwaya et al.
2011/0064450 A1 3/2011 Ishii et al.
2011/0064451 A1 3/2011 Yamaguchi et al.
2011/0064490 A1 3/2011 Imada et al.
2011/0064502 A1 3/2011 Hase et al.
2011/0076071 A1 3/2011 Yamaguchi et al.
2011/0085815 A1 4/2011 Kishi et al.
2011/0085832 A1 4/2011 Hasegawa et al.
2011/0091253 A1 4/2011 Seo et al.
2011/0116848 A1 5/2011 Yamaguchi et al.
2011/0129268 A1 6/2011 Ishii et al.
2011/0150518 A1 6/2011 Hase et al.
2011/0170917 A1 7/2011 Yoshikawa et al.
2011/0176821 A1 7/2011 Hase
2011/0176822 A1 7/2011 Ishii et al.
2011/0182634 A1 7/2011 Ishigaya et al.
2011/0182638 A1 7/2011 Ishii et al.
2011/0194869 A1 8/2011 Yoshinaga et al.
2011/0194870 A1 8/2011 Hase et al.
2011/0200368 A1 8/2011 Yamaguchi et al.
2011/0200370 A1 8/2011 Ikebuchi et al.
2011/0206427 A1 8/2011 Iwaya et al.
2011/0211876 A1 9/2011 Iwaya et al.
2011/0217056 A1 9/2011 Yoshinaga et al.
2011/0217057 A1 9/2011 Yoshinaga et al.
2011/0217093 A1 9/2011 Tokuda et al.
2011/0217095 A1 9/2011 Ishii et al.
2011/0222875 A1 9/2011 Imada et al.
2011/0222876 A1 9/2011 Yuasa et al.
2011/0222888 A1 9/2011 Ikebuchi et al.
2011/0222926 A1 9/2011 Ueno et al.
2011/0222929 A1 9/2011 Fujimoto et al.
2011/0222930 A1 9/2011 Fujimoto et al.
2011/0222931 A1 9/2011 Shinshi et al.
2011/0222938 A1 9/2011 Watanabe et al.
2011/0229161 A1 9/2011 Ueno et al.
2011/0229162 A1 9/2011 Ogawa et al.
2011/0229178 A1 9/2011 Ogawa et al.
2011/0229180 A1 9/2011 Saito
2011/0229181 A1 9/2011 Iwaya et al.
2011/0229200 A1 9/2011 Yamaguchi et al.
2011/0229225 A1 9/2011 Ishii et al.
2011/0229226 A1 9/2011 Tokuda et al.
2011/0229227 A1 9/2011 Yoshikawa et al.

(56) References Cited

U.S. PATENT DOCUMENTS

| | | | | |
|---|---|---|---|---|
| 2011/0229228 | A1 | 9/2011 | Yoshikawa et al. | |
| 2011/0229236 | A1 | 9/2011 | Ehara et al. | |
| 2011/0274453 | A1 | 11/2011 | Shimokawa et al. | |
| 2011/0286758 | A1 | 11/2011 | Yoshinaga | |
| 2011/0293309 | A1 | 12/2011 | Hase | |
| 2011/0311284 | A1 | 12/2011 | Seo et al. | |
| 2012/0008971 | A1* | 1/2012 | Lee et al. | 399/69 |
| 2012/0045226 | A1 | 2/2012 | Hase et al. | |
| 2012/0051766 | A1 | 3/2012 | Ueno et al. | |
| 2012/0051774 | A1 | 3/2012 | Ikebuchi et al. | |
| 2012/0093531 | A1 | 4/2012 | Yuasa et al. | |
| 2012/0093551 | A1 | 4/2012 | Ogawa et al. | |
| 2012/0107005 | A1 | 5/2012 | Hase et al. | |
| 2012/0114345 | A1 | 5/2012 | Fujimoto et al. | |
| 2012/0114354 | A1 | 5/2012 | Saito et al. | |
| 2012/0121303 | A1 | 5/2012 | Takagi et al. | |
| 2012/0121304 | A1 | 5/2012 | Tokuda et al. | |
| 2012/0121305 | A1 | 5/2012 | Yoshikawa et al. | |
| 2012/0148303 | A1 | 6/2012 | Yamaguchi et al. | |
| 2012/0155935 | A1 | 6/2012 | Yoshikawa et al. | |
| 2012/0155936 | A1 | 6/2012 | Yamaguchi et al. | |
| 2012/0177388 | A1 | 7/2012 | Imada et al. | |
| 2012/0177393 | A1 | 7/2012 | Ikebuchi et al. | |
| 2012/0177420 | A1 | 7/2012 | Shimokawa et al. | |
| 2012/0177423 | A1 | 7/2012 | Imada et al. | |
| 2012/0177424 | A1 | 7/2012 | Saito et al. | |
| 2012/0207523 | A1 | 8/2012 | Ueno et al. | |
| 2012/0219312 | A1 | 8/2012 | Yuasa et al. | |
| 2012/0224878 | A1 | 9/2012 | Ikebuchi et al. | |
| 2012/0237273 | A1 | 9/2012 | Yoshinaga et al. | |
| 2013/0045032 | A1 | 2/2013 | Shimokawa et al. | |
| 2013/0136479 | A1 | 5/2013 | Yuasa et al. | |
| 2013/0195493 | A1 | 8/2013 | Hase et al. | |
| 2013/0209119 | A1 | 8/2013 | Yuasa et al. | |
| 2013/0209124 | A1 | 8/2013 | Saito et al. | |
| 2013/0209131 | A1 | 8/2013 | Uchitani et al. | |

FOREIGN PATENT DOCUMENTS

| | | |
|---|---|---|
| JP | 2007-334205 | 12/2007 |
| JP | 2010-217205 | 9/2010 |
| JP | 2010-217257 | 9/2010 |
| JP | 2011-197020 | 10/2011 |

* cited by examiner

FIXING DEVICE WITH A TEMPERATURE DETECTOR ADJACENT AN EASILY DEFORMABLE LOCATION AND IMAGE FORMING APPARATUS INCLUDING SAME

CROSS-REFERENCE TO RELATED APPLICATIONS

This patent application is based on and claims priority pursuant to 35 U.S.C. §119 to Japanese Patent Application No. 2012-026030, filed on Feb. 9, 2012, in the Japan Patent Office, the entire disclosure of which is hereby incorporated by reference herein.

BACKGROUND OF THE INVENTION

1. Field of the Invention

Exemplary aspects of the present disclosure generally relate to a fixing device and an image forming apparatus, and more particularly, to a fixing device for fixing a toner image on a recording medium and an image forming apparatus including the fixing device.

2. Description of the Related Art

Related-art image forming apparatuses, such as copiers, facsimile machines, printers, or multifunction printers having at least one of copying, printing, scanning, and facsimile capabilities, typically form an image on a recording medium according to image data. Thus, for example, a charger uniformly charges a surface of an image bearing member (which may, for example, be a photosensitive drum); an optical writer projects a light beam onto the charged surface of the image bearing member to form an electrostatic latent image on the image bearing member according to the image data; a developing device supplies toner to the electrostatic latent image formed on the image bearing member to render the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

Known fixing devices employ a belt-type fixing member (hereinafter referred to simply as fixing belt) to fix an unfixed toner image onto a recording medium such as paper and an OHP film. In order to facilitate an understanding of the novel features of the present invention, as a comparison, a description is provided of conventional fixing devices with reference to FIGS. 9 and 10. As illustrated in FIG. 9, an example of such a fixing device using a fixing belt includes a looped belt 100, a tubular metal thermal conductor 200 disposed inside the loop formed by the belt 100, a heat source 300 disposed inside the metal thermal conductor 200, and a pressing roller 400 that contacts the metal thermal conductor 200 via the belt 100 to form a nip portion N. The heat source 300 in the metal thermal conductor 200 heats the belt 100 through the metal thermal conductor 200.

Another example of the fixing device using the fixing belt heats the belt directly without the metal thermal conductor as illustrated in FIG. 10. As illustrated in FIG. 10, the fixing device includes the belt 100 without the metal thermal conductor, but instead, a planar nip forming member 500 is disposed opposite the pressing roller 400. The heat source 300 is disposed inside the looped belt 100. In this configuration, the heat source 300 can heat a certain area of the belt 100 at which the nip forming member 500 is disposed, but other areas of the belt 100 as well, thereby increasing significantly heat transfer efficiency and hence reducing power consumption. Accordingly, a first print time from a standby state can be shortened.

To shorten a warm-up time and the first print time, the fixing belt may be made thin. However, the thin belt does not have good thermal conductivity and the belt is not heated uniformly when heated by the heat source. More specifically, in order to enhance the heat transfer efficiency, the fixing device may employ a reflective plate to concentrate heat to specific areas of the fixing belt. In this configuration, when heated, the specific areas of the fixing belt are heated selectively and the temperature thereof is higher than that of other areas. In a case in which a plurality of heat sources are employed, specific areas of the fixing belt at which the heat generating portions of the heat sources overlap in a longitudinal direction (a direction perpendicular to a sheet moving direction) are heated more than other areas.

If the temperature of the fixing belt is partially high, thermal expansion of that place is greater than that of other areas, causing deformation of the fixing belt. More specifically, the fixing belt expands outward.

Generally, the fixing device using the fixing belt employs a temperature detector for detecting the temperature of the fixing belt. However, when the fixing belt expands outward as described above, relative positions of the fixing belt and the temperature detector change, causing inaccurate detection of the temperature of the fixing belt.

In view of the above, there is demand for a fixing device capable of detecting the temperature of a fixing belt accurately even when the temperature thereof is high, and an image forming apparatus including the fixing device.

SUMMARY OF THE INVENTION

In view of the foregoing, in an aspect of this disclosure, there is provided an improved fixing device for fixing an unfixed image onto a recording medium including a fixing belt, a nip forming member, an opposing rotary member, a heater, and a temperature detector. The fixing belt is formed into a loop to move endlessly and fix the unfixed image on the recording medium. The nip forming member is disposed inside the loop formed by the fixing belt. The opposing rotary member contacts the nip forming member via the fixing belt to form a nip portion therebetween while rotating. The heater heats the fixing belt at a place other than the nip portion. The temperature detector detects a temperature of the surface of the fixing belt. The temperature detector detects the temperature near a place of the fixing belt that easily deforms as the fixing belt is heated by the heater.

According to another aspect, an image forming apparatus includes the fixing device.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF THE INVENTION

Figure 1:
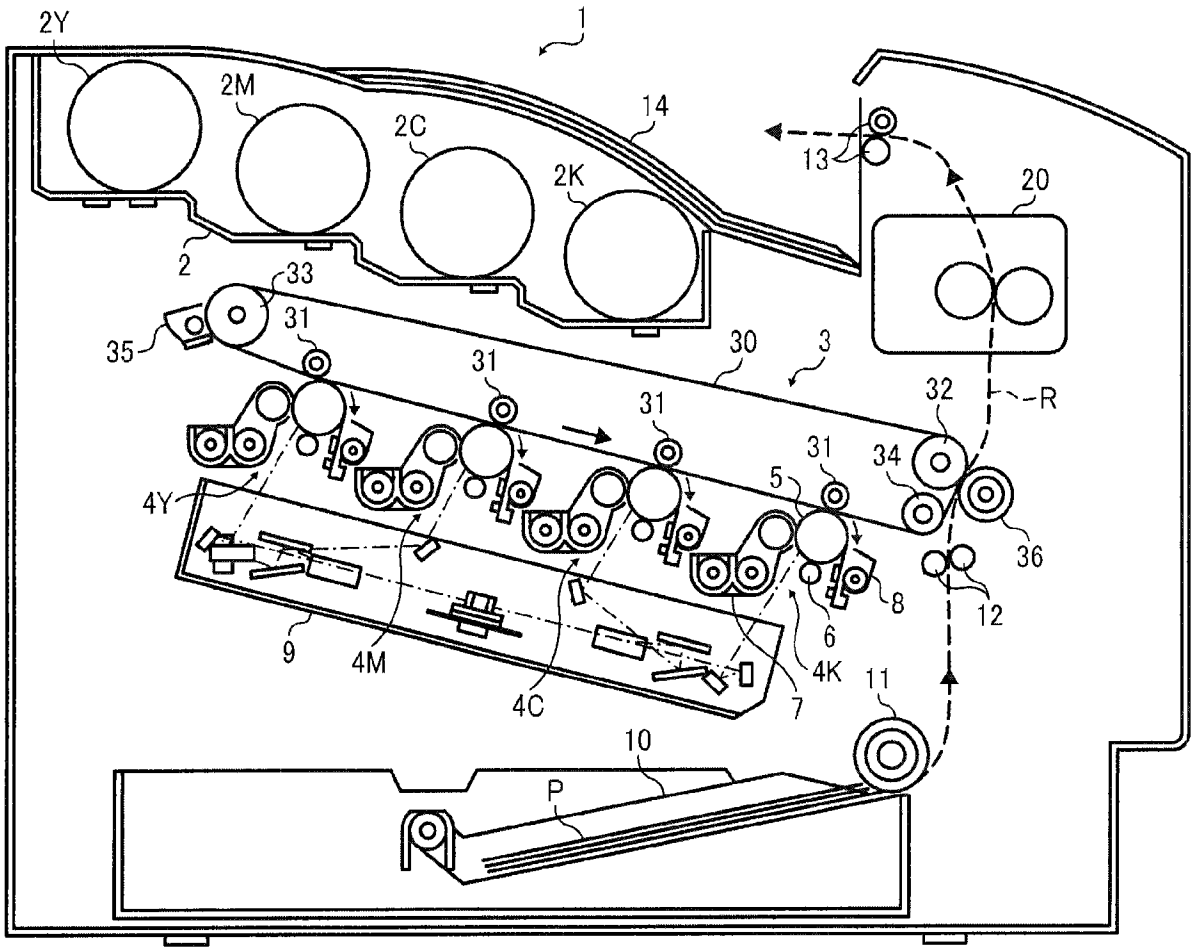
FIG. 1 is a schematic diagram illustrating an example of an image forming apparatus according to an illustrative embodiment of the present invention.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, and initially with reference to FIG. 1, a description is provided of an image forming apparatus according to an aspect of this disclosure.

Figure 2:
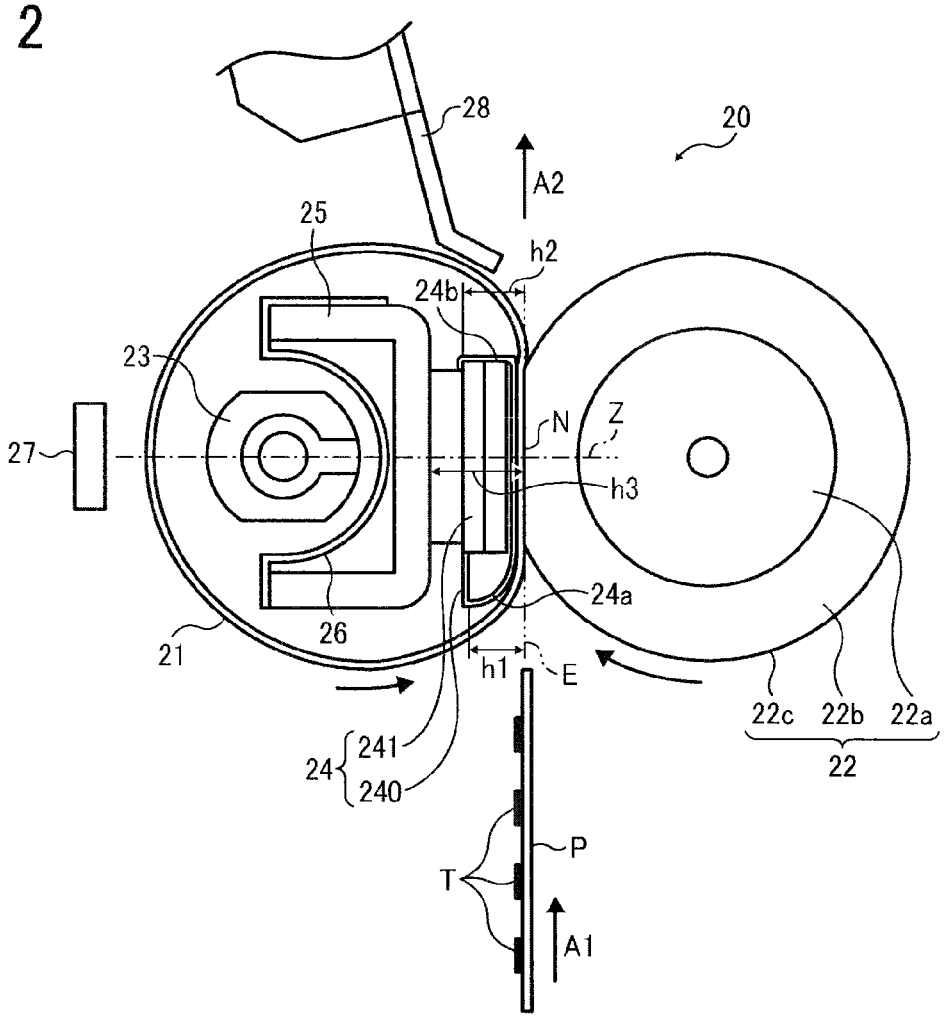
FIG. 2 is a cross-sectional view schematically illustrating a fixing device employed in the image forming apparatus of FIG. 1.

FIG. 1 is a schematic diagram illustrating a color laser printer as an example of an image forming apparatus 1 according to a first illustrative embodiment of the present invention. With reference to FIG. 2, initially, a description is provided of a fixing device 20 employed in the image forming apparatus 1 of FIG. 1. FIG. 2 is a schematic diagram illustrating the fixing device 20.

As illustrated in FIG. 2, the fixing device 20 includes a rotatable fixing belt 21 serving as a fixing member; a rotatable pressing roller 22 as an opposing member disposed opposite the fixing belt 21; a halogen heater 23 serving as a heat source that heats the fixing belt 21; a nip forming member 24 disposed inside the fixing belt 21; a stay 25 serving as a support member for supporting the nip forming member 24; a reflective member 26 that reflects light emitted from the halogen heater 23 onto the fixing belt 21; a temperature detector 27 serving as a temperature detecting mechanism for detecting the temperature of the fixing belt 21; a separation member 28 for separating a recording medium from the fixing belt 21; and a pressure mechanism, not illustrated, for pressing the pressing roller 22 towards the fixing belt 21, and so forth.

The fixing belt 21 is formed of a thin, flexible endless-shaped belt member (including a film). More specifically, the fixing belt 21 includes a base member that constitutes an inner peripheral side thereof formed of a metal material such as nickel or SUS or a resin material such as polyimide (PI), and a separating layer that constitutes an outer peripheral side formed of tetrafluoroethylene-perfluoroalkylvinylether copolymer (PFA) or polytetrafluoroethylene (PTFE). An elastic layer made of a rubber material such as silicone rubber, foam silicone rubber, or fluoro-rubber may be provided between the base member and the separating layer.

The pressing roller 22 is formed of a metal cored bar 22*a*, an elastic layer 22*b* made of foam silicone rubber, silicone rubber or fluoro-rubber which is provided on the surface of the metal cored bar 22*a*, and a separating layer 22*c* made of PFA or PTFE which is provided on the surface of the elastic layer 22*b*. The pressing roller 22 is pressed against the fixing belt 21 side by a pressing mechanism and is in contact with the nip forming member 24 via the fixing belt 21. At a place where the pressing roller 22 and the fixing belt 21 meet and press against each other, the elastic layer 22*b* of the pressing roller 22 is pressed against the fixing belt 21 to form a nip portion N with a predetermined width. The pressing roller 22 is rotated by a drive source such as a motor disposed in the main body of the image forming apparatus 1. When the pressing roller 22 is rotated, the driving force is transmitted to the fixing belt 21 at the nip portion N, causing the fixing belt 21 to rotate.

In the present illustrative embodiment, the pressing roller 22 is a hollow roller, but it may be a solid roller. Furthermore, a heat source such as a halogen heater may be disposed inside the pressing roller 22.

In a case in which the pressing roller 22 does not include the elastic layer 22*b*, a heat capacity becomes less, thereby improving fixing properties, but when unfixed toner is pressed against the recording medium, microasperities on the belt surface may show up in a resulting output image and uneven brightness may occur in a solid part of the image.

To address this difficulty, it is desirable that an elastic layer have a thickness of not smaller than 100 μm. The elastic layer with a thickness of not smaller than 100 μm absorbs asperities of the belt by the elastic deformation of the elastic layer, thereby preventing uneven brightness. The elastic layer 22*b* may be solid rubber, but sponge rubber may be used if the pressing roller 22 does not have the heat source inside thereof. The sponge rubber is more preferred since it enhances thermal insulation properties to maintain the temperature of the fixing belt 21.

Each end of the halogen heater 23 is fixed to a side plate (not illustrated) of the fixing device 20. A power source unit provided in the main body of the image forming apparatus controls output of the halogen heater 23 to generate heat based on results of detection of the surface temperature of the fixing belt 21 detected by the temperature detector 27. Such output control on the heater 23 sets the temperature (fixing temperature) of the fixing belt 21 to a desired temperature. Furthermore, as the heat source that heats the fixing belt 21, IH (induction heating), a resistive heating element, a carbon heater or the like may be used other than halogen heaters.

As illustrated in FIG. 2, the nip forming member 24 includes a base pad 241, and a sliding sheet (low friction sheet) 240 provided on the surface of the base pad 241. The base pad 241 is long over the axial direction of the fixing belt 21 or the axial direction of the pressing roller 22, and determines the shape of the nip portion N by receiving pressure from the pressing roller 22. Furthermore, the base pad 241 is fixedly supported by the stay 25. This can prevent deformation of the nip forming member 24 due to pressure by the pressing roller 22, so as to obtain a uniform nip width over the axial direction of the pressing roller 22.

It is to be noted that in order to prevent deformation of the nip forming member 24, desirably, the stay 25 is formed of a metal material with high mechanical strength, such as stainless steel and iron. Furthermore, the base pad 241 is desirably formed of a material with certain hardness for ensuring the strength. As a material for the base pad 241, a resin such as a liquid crystal polymer (LCP), metal, ceramic, or the like can be used.

Furthermore, the base pad 241 is formed of a heat resistant member with a heat resistant temperature of equal to or greater than 200° C. With this configuration, deformation of the nip forming member 24 caused by heat is prevented in a toner fixing temperature range, thereby reliably maintaining a desirable condition of the nip portion N and hence stabilizing quality of an output image. For the base pad 241, a known heat resistant resin may be utilized.

The sliding sheet 240 may at least be disposed on the surface of the base pad 241 facing the fixing belt 21. With this configuration, when the fixing belt 21 rotates, the fixing belt 21 slides with respect to the low-friction sliding sheet 240, thereby reducing a driving torque that is generated in the fixing belt 21 and hence reducing a load on the fixing belt 21 caused by frictional force. Alternatively, a configuration without the sliding sheet may also be applicable.

The reflective member 26 is disposed between the stay 25 and the halogen heater 23. According to the present illustrative embodiment, the reflective member 26 is fixed to the stay 25. Because the reflective member 26 is directly heated by the halogen heater 23, the reflective member 26 is desirably formed of a metal material having a high melting point. Examples of material for the reflective member 26 include, but are not limited to aluminum and stainless steel. As the reflective member 26 is disposed in such a manner, light emitted from the halogen heater 23 towards the stay 25 is reflected onto the fixing belt 21. This can increase an amount of light that illuminates the fixing belt 21, thereby heating efficiently the fixing belt 21. Furthermore, since it is possible to suppress transmission of radiant heat from the halogen heater 23 to the stay 25 and so forth, energy can be saved.

Alternatively, the reflective member 26 may not be provided. In such a case, the surface of the stay 25 at the halogen heater side 23 may have a mirror surface finish through polishing or painting to form a reflective plane. The reflectivity of the reflective plane of the reflective member 26 or the stay 25 is desirably equal to or greater than 90%.

In order to ensure the strength of the stay 25, the shape and material of the stay 25 are limited. Thus, as in the present illustrative embodiment, the reflective member 26 provides greater flexibility in the shape and the material of the stay 25, and the reflective member 26 and the stay 25 can focus on their respective functions. Furthermore, providing the reflective member 26 between the halogen heater 23 and the stay 25 shortens the distance between the reflective member 26 and the halogen heater 23. With this configuration, the fixing belt 21 can be heated efficiently.

Figure 3:
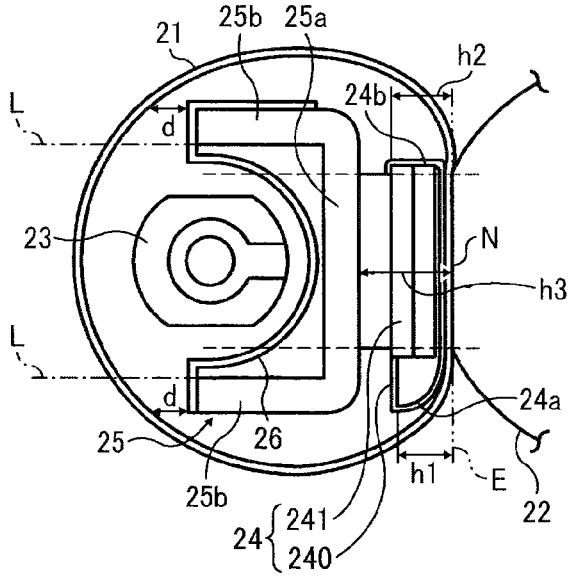
FIG. 3 is a partially enlarged cross-sectional view schematically illustrating a stay employed in the fixing device of FIG. 2.

With reference to FIG. 3, a description is provided of the stay 25 in detail. FIG. 3 is a partially enlarged cross-sectional view illustrating the stay 25. In order to ensure the strength of the stay 25, in the present illustrative embodiment, the stay 25 has a base portion 25*a* which is in contact with the nip forming member 24 and extends in the sheet transport direction (the vertical direction of FIG. 2), and rising portions 25*b* which extend from the respective ends on the upstream side and the downstream side of the base portion 25*a* in the sheet transport direction towards a pressing direction of the pressing roller 22 (towards the left side of FIG. 2).

The rising portions 25*b* are spaced apart a certain distance in the sheet transport direction, each disposed outside an end portion of the nip portion N indicated by a broken line in FIG. 3. In other words, one of the rising portions 25*b*, that is, the rising portion 25*b* at the upstream side in the sheet transport direction (lower side in FIG. 3), is disposed upstream from the upstream end of the nip portion N. Another of the rising portions 25*b*, that is, the rising portion 25*b* at the downstream side in the sheet transport direction (upper side in FIG. 3), is disposed downstream from the downstream end of the nip portion N.

With the pair of the rising members 25*b* extending in the pressing direction of the pressing member 22, the stay 25 has a horizontally long cross section extending in the pressing direction of the pressing roller 22, thereby increasing the section modulus and hence enhancing the mechanical strength of the stay 25.

It is to be noted that each of the rising portions 25*b* is disposed at least at a position corresponding to the end portion of the nip portion N or outside the nip portion N. In other words, providing the rising portions 25*b* each at the end portions of or outside a pressure receiving area pressed by the pressing roller 22 can enhance the strength of the base portions 25*a* against the pressure of the pressing roller 22. The number of the rising portions 25*b* is not limited to two. Three rising portions 25*b* or more can be provided.

Furthermore, according to the present illustrative embodiment, in order to enhance the strength of the stay 25, the tip of the rising section 25*b* is disposed as close to the inner peripheral surface of the fixing belt 21 as possible. However, since vibration (disturbance of behavior) occurs in some degree in the fixing belt 21 during its rotation, when the tip of the rising portion 25*b* is brought excessively close to the inner peripheral surface of the fixing belt 21, the fixing belt 21 may come into contact with the tip of the rising portion 25*b*. Especially when the fixing belt 21 is thin as in the present illustrative embodiment, a degree of vibration of the fixing belt 21 is large and hence the position of the tip of the rising portion 25*b* needs to be determined carefully.

More specifically, according to the present illustrative embodiment, a distance "d" shown in FIG. 3 between the tip of the rising portion 25*b* and the inner peripheral surface of the fixing belt 21 in the contact direction of the pressing roller 22 is preferably at least 2.0 mm, and more preferably, equal to or greater than 3.0 mm. By contrast, when the fixing belt 21 has a certain thickness and hardly vibrates, the distance d can be set to approximately 0.02 mm. It is to be noted that in a case in which the reflective member 26 is attached to the tip of the rising portions 25*b* as in the present illustrative embodiment, the distance d needs to be set such that the reflective member 26 does not contact the fixing belt 21.

As described above, disposing the tip of the rising portion 25*b* as close to the inner peripheral surface of the fixing belt 21 as possible allows the rising portions 25*b* to be long in the contact direction of the pressing roller 22. With this configuration, the mechanical strength of the stay 25 can be enhanced even if the fixing belt 21 has a small diameter.

Moreover, in order to make the stay 25 as large as possible in the fixing belt 21, the nip forming member 24 is formed to be compact. More specifically, the width of the base pad 241 in the sheet transport direction is narrower than the width of the stay 25 in the sheet transport direction.

Furthermore, in FIG. 3, when heights of an upstream end 24*a* of the base pad 241 and a downstream end 24*b* of the base pad 241 in the sheet transport direction with respect to the nip portion N or its virtual extended line E are referred to as h1 and h2, respectively, and when the maximum height of the portion of the base pad 241 other than the upstream end 24*a* and the downstream end 24*b* with respect to the nip portion N (or its virtual extended line E) is referred to as h3, the following relation is satisfied: $h1 \leq h3$, $h2 \leq h3$. With this configuration, the upstream end 24*a* and the downstream end 24*b* of the base pad 241 are not located between the fixing belt 21 and the respective bent sections (25*b*) of the stay 25 on the upstream side and the downstream side in the sheet transport direction, and hence the respective bent sections (25*b*) can be brought close to the inner peripheral surface of the fixing belt 21. This allows the stay 25 to take up as much area as possible inside the limited space inside the fixing belt 21, thereby ensuring the strength of the stay 25.

According to the present illustrative embodiment, no guide member, other than the nip forming member 24, is provided between the fixing belt 21 and the stay 25 so that the stay 25 is disposed close to the fixing belt 21 and the strength of the stay 25 is enhanced. (In this configuration, a belt holder 40 is provided at the belt end to serves as a guide member.)

As illustrated in FIG. 3, the halogen heater 23 is disposed between the rising portions 25*b*, or within extension lines L each indicated by a broken line which is a line extended from the inner surface of the rising portion 25*b*. With this configuration, the halogen heater 23 and the stay 25 can be housed compact in the fixing belt 21. Furthermore, according to the present illustrative embodiment, the halogen heater 23 is disposed substantially at the center of the nip portion N in the sheet transport direction.

According to the present illustrative embodiment, at least a portion of the halogen heater 23 is disposed inside the stay 25, thereby focusing the range of light from the halogen heater 23 to the fixing belt 21 to a desired range. Generally, the temperature of the fixing belt 21 near the halogen heater 23 in the circumferential direction of the fixing belt 21 tends to be high. By contrast, the temperature of the fixing belt 21 relatively far from the halogen heater 23 tends to be low. Thus, placing the halogen heater 23 inside the stay 25 can focus the illumination range of light from the halogen heater 23 to the fixing belt 21 to a desired range within which distance variations are less than other areas. Accordingly, heating temperature variations can be reduced, hence enhancing imaging quality.

According to the present illustrative embodiment, for the sake of further energy saving and improvement in first print output time, the fixing device 20 employs a direct heating method in which the fixing belt 21 is directly heated by the halogen heater 23 at a place other than the nip portion N. (Direct heating method) In the present illustrative embodiment, nothing is placed between the halogen heater 23 and the left-side portion of the fixing belt 21 of FIG. 2, thereby heating directly the fixing belt 21 with radiant heat from the halogen heater 23.

Furthermore, in order to achieve a low heat capacity, the fixing belt 21 is made thin and has a small diameter. More specifically, respective thicknesses of the base member, the elastic layer, and the separating layer constituting the fixing belt 21 are configured to be in a range of from 20 μm to 50 μm, 100 μm to 300 μm, and 10 μm to 50 μm, respectively, and a thickness as a whole is equal to or less than 1 mm. Furthermore, the diameter of the fixing belt 21 is in a range of from 20 mm to 40 mm. Furthermore, in order to obtain a low heat capacity, a total thickness of the fixing belt 21 is desirably equal to or less than 0.2 mm, and more desirably, equal to or less than 0.16 mm. Moreover, the diameter of the fixing belt 21 is desirably equal to or less than 30 mm.

It is to be noted that in the present illustrative embodiment, the diameter of the pressing roller 22 is in a range of from 20 mm to 40 mm, and the diameter of the fixing belt 21 and the diameter of the pressing roller 22 are configured to be the same. However, the configuration of the fixing belt 21 and the pressing roller 22 is not limited to this. For example, the diameter of the fixing belt 21 may be smaller than the diameter of the pressing roller 22. In that case, a curvature of the fixing belt 21 in the nip portion N becomes smaller than a curvature of the pressing roller 22, thereby separating the recording medium P being output from the nip portion N easily from the fixing belt 21.

Figure 4A:
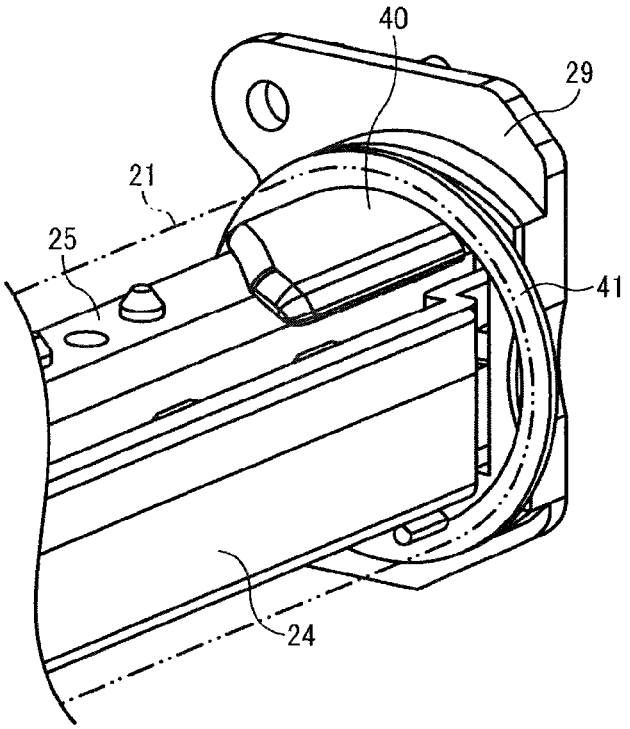
FIG. 4A is a plan view schematically illustrating an end portion of a fixing sleeve of the fixing device.
Figure 4B:
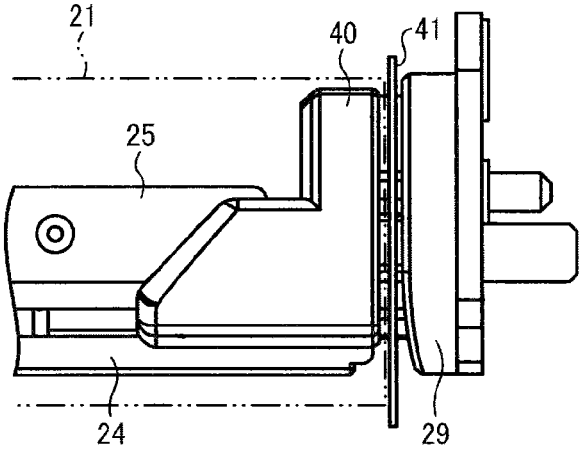
FIG. 4B is a top view schematically illustrating the end portion of the fixing sleeve of FIG. 4A.
Figure 4C:
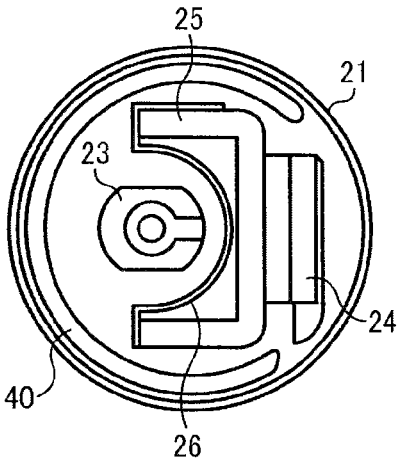
FIG. 4C is a side view schematically illustrating the end portion of the fixing sleeve as viewed from a direction of an axis of rotation of the fixing belt.

With reference to FIGS. 4A through 4C, a description is provided of the stay 25 in detail. FIG. 4A is a perspective view schematically illustrating an end portion of the fixing belt 21. FIG. 4B is a plan view schematically illustrating the end portion of the fixing belt 21. FIG. 4C is a side view schematically illustrating the fixing belt 21 as viewed from a direction of an axis of rotation of the fixing belt 21. Although only the configuration of one end of the fixing belt 21 is illustrated in the drawings, the other end is configured in a similar manner. Thus, the description is provided of one end of the fixing belt 21 as a representative example.

As illustrated in FIGS. 4A and 4B, a flange 29 is provided to an end portion of the fixing belt 21 in the axial direction (longitudinal direction) of the fixing belt 21 and the stay 25. The flange 29 is supported by a housing of the fixing device 20. The belt holder 40 inserted into the looped fixing belt 21 is attached to the flange 29, and the end portion of the stay 25 is fixed to the belt holder 40, thereby positioning the belt holder 40 in place. Accordingly, the stay 25 is supported by the flange 29 via the belt holder 40. Each end of the fixing belt 21 is rotatably held by the belt holder 40. That is, both ends of the stay 25 are supported by the flanges 29 (in the drawings, only one side is shown). The fixing belt 21 is disposed between the flanges 29. As illustrated in FIG. 4C, the belt holder 40 is formed in a sidewardly open C-shape, with the opening facing the nip portion (the position where the nip forming member 24 is disposed).

Moreover, as illustrated in FIG. 4A and FIG. 4B, a slip ring 41 serving as a protective member for protecting the end portion of the fixing belt 21 is provided between the end surface of the fixing belt 21 and the flange 29. Therefore, when the balance of the fixing belt 21 is shifted in the axial direction, it is possible to prevent the end of the fixing belt 21 from coming into direct contact with the flange 29, thus preventing friction or damage of the end. Furthermore, the slip ring 41 is fitted to the belt holder 40 with some allowance between the slip ring 41 and the outer periphery of the belt holder 40. For this reason, when the end of the fixing belt 21 comes into contact with the slip ring 41, the slip ring 41 is rotatable along with the fixing belt 21, but the slip ring 41 may stand still without rotating along with the fixing belt 21. As a material for the slip ring 41, it is preferable to employ so-called super engineering plastic excellent in heat resistance, such as PEEK, PPS, PAI or PTFE.

It should be noted that a shielding member for shielding heat from the halogen heater 23 is disposed between the fixing belt 21 and the halogen heater 23 at both ends of the fixing belt 21 in the axial direction. This can suppress an excessive temperature rise in a no-recording medium passing region of the fixing belt 21 during continuous passing of recording media, hence preventing degradation and damage of the fixing belt 21.

Referring back to FIG. 2, a basic operation of the fixing device according to the present illustrative embodiment will be described. When the power of the main body of the image forming apparatus 1 is turned on, power is applied to the halogen heater 23, while the pressing roller 22 starts to rotate in the clockwise direction in FIG. 2. Thereby, the fixing belt 21 is rotated counterclockwise in FIG. 2 due to frictional force with the pressing roller 22.

Subsequently, by the above-described image formation process, the recording medium P bearing an unfixed toner image T is delivered in a direction of an arrow A1 of FIG. 2 while being guided by a guide plate and sent into the nip portion N between the fixing belt 21 and the pressing roller 22 pressingly contacting the fixing belt 21. Then, the toner image T is fixed to the surface of the recording medium P by the heat applied by the fixing belt 21 heated by the halogen heater 23 and the pressure between the fixing belt 21 and the pressing roller 22.

The recording medium P on which the toner image T is fixed is carried out of the nip portion N in a direction of an arrow A2 in FIG. 2. At this time, the tip of the recording medium P comes into contact with the tip of the separation member 28 and the recording medium P is separated from the fixing belt 21. Thereafter, the separated recording medium P is output to the outside of the apparatus by a sheet output roller and stacked in an output sheet tray 14 (illustrated in FIG. 1).

According to the present illustrative embodiment, after a print job, the fixing belt 21 is rotated to prevent the fixing belt 21 from getting heated excessively. This rotation after the print job is referred to as a post-job rotation. At the post-job rotation, the temperature of the fixing belt 21 is adjusted by two steps that satisfy the following relation: H>b>a, where H is a fixing control temperature, "b" is a second preset temperature, and "a" is a first preset temperature.

More specifically, after the print job, the halogen heater 23 is turned off and if the temperature of the fixing belt 21 detected by the temperature detector 27 is equal to or greater than the second preset temperature "b", the pressing roller 22 is rotated, causing the fixing belt 21 to rotate. If the temperature of the fixing belt 21 is lower than the second preset temperature "b", rotation of the pressing roller 22 is stopped. If the temperature of the fixing belt 21 is equal to or greater than the first preset temperature "a", the apparatus is prevented from going into standby (sleep) mode. If the temperature of the fixing belt 21 is lower than the first preset temperature a, the apparatus goes into standby (sleep) mode.

Figure 5:
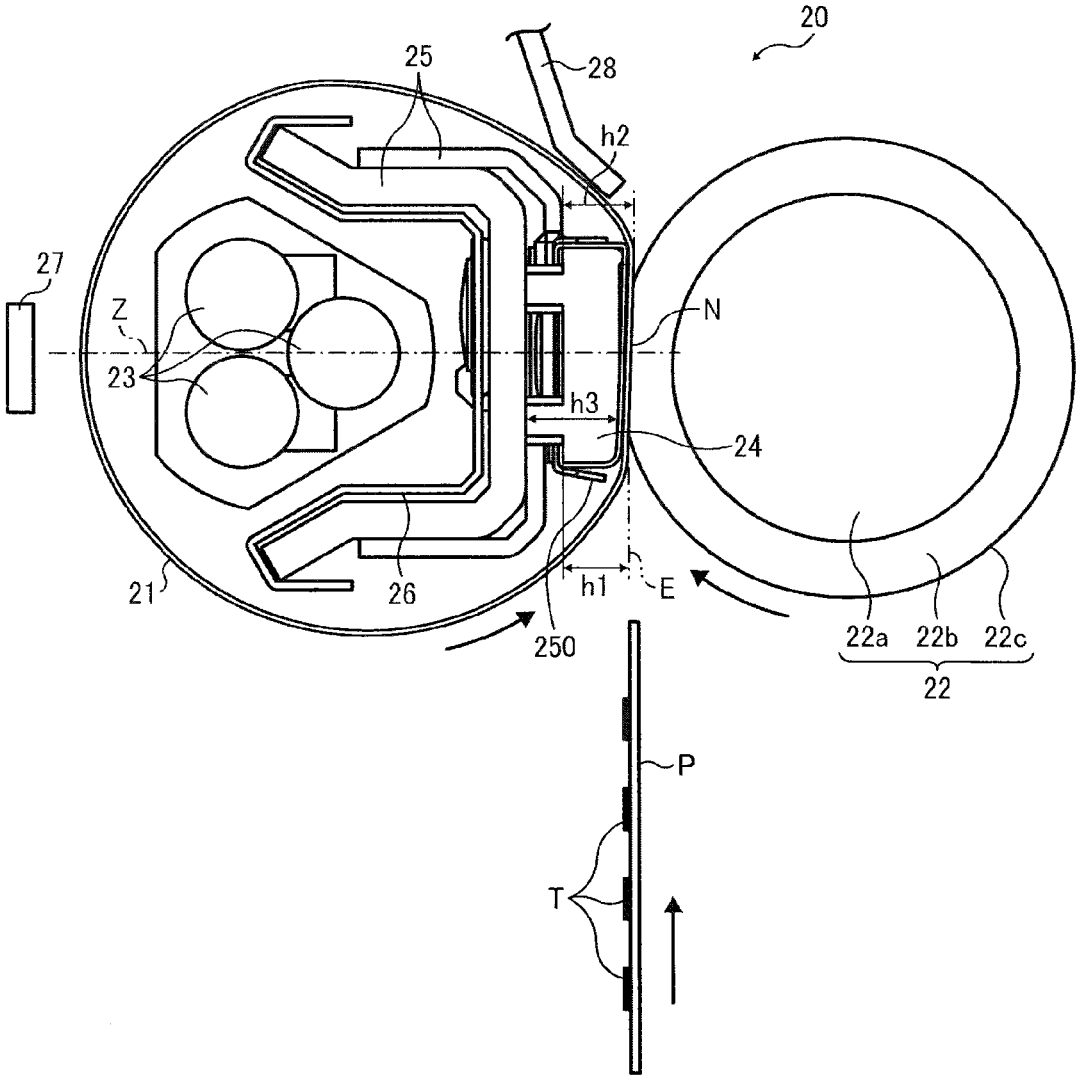
FIG. 5 is a schematic diagram illustrating a fixing device according to another illustrative embodiment of the present invention.

With reference to FIG. 5, a description is provided of a fixing device according to a second illustrative embodiment of the present invention. FIG. 5 is a cross-sectional diagram schematically illustrating the fixing device of the second illustrative embodiment. The fixing device 20 includes a plurality of halogen heaters 23. According to the present illustrative embodiment, three halogen heaters 23 are provided as illustrated in FIG. 5. In this case, each of the halogen heaters 23 has different heat generating regions so that the area of the fixing belt 21 getting heated can be different so as to accommodate different widths of recording media sheets.

It is to be noted that in FIG. 5, a metal sheet 250 is provided to surround the nip forming member 24, and in this case, the nip forming member 24 is supported by the stay 25 via the metal sheet 250. Configurations other than the above are basically similar to the configurations of the embodiment illustrated in FIG. 2 described above.

In FIG. 5, h1, h2, and h3 represent heights of the base pad 241 as in the foregoing embodiment. According to the present illustrative embodiment, in order to make the stay 25 as large as possible within the given space in the fixing belt 21, the following relation is satisfied: $h1 \leq h3$, $h2 \leq h3$.

According to the present illustrative embodiment, the fixing device 20 includes the reflective member 26 to enhance heating efficiency. In this configuration, light projected from the halogen heaters 23 towards the stay 25 is reflected to the fixing belt 21, and heat from the heat sources such as the halogen heaters 23 is concentrated at a certain region of the fixing belt 21. Instead of using the reflective member 26, alternatively, the stay 25 may have a reflective surface. Thus, the certain region of the fixing belt 21 is selectively heated, the temperature thereof is higher than other places. In this configuration, the portion of the fixing belt 21 with a higher temperature than other places deforms and expands thermally out of the cylindrical shape. In such a case, when providing the temperature detector at a place other than the place corresponding to the deformed place of the fixing belt 21, the deformed fixing belt 21 does not face straight to the temperature detector. As a result, the temperature of the fixing belt is not detected accurately (Detection accuracy decreases).

In view of the above, according to the illustrative embodiment of the present invention, the temperature detector 27 is provided to the place corresponding to the portion of the fixing belt 21 that deforms the most or deforms easily so as to detect the temperature of the portion or near the portion of the fixing belt 21. With this configuration, even when the fixing belt 21 deforms due to thermal expansion, the angle and positional relations of the fixing belt 21 relative to the temperature detector 27 do not easily change, thereby maintaining detection accuracy of the temperature detector 27. Furthermore, in a case in which the temperature of the fixing belt 21 increases and reaches high, the fixing belt 21 deforms towards the temperature detector. Therefore, the temperature detection accuracy does not decrease.

Next, a description is provided of deformation of certain areas of the fixing belt 21 that deform the most or deform easily. In FIGS. 2 and 5, the pressing roller 22 presses the fixing belt 21 in the cross-sectional direction of the fixing belt 21 which is a direction perpendicular to the shaft of the pressing roller 22. The opposite side of the fixing belt 21 to the pressing roller 22 in cross section is not supported. Thus, the fixing belt 21 keeps its substantially-cylinder shape by its stiffness only. In this state, when heated by the halogen heater 23, a certain area of the fixing belt 21 where the heat is concentrated expands the most, and hence that area of the fixing belt 21 deforms and expands thermally out of the cylindrical shape. Therefore, the place at which the heat from the halogen heater 23 (and the reflective plate 26) is concentrated deforms the most (deformed easily) in the cross-sectional direction of the fixing belt 21.

Figure 6A:
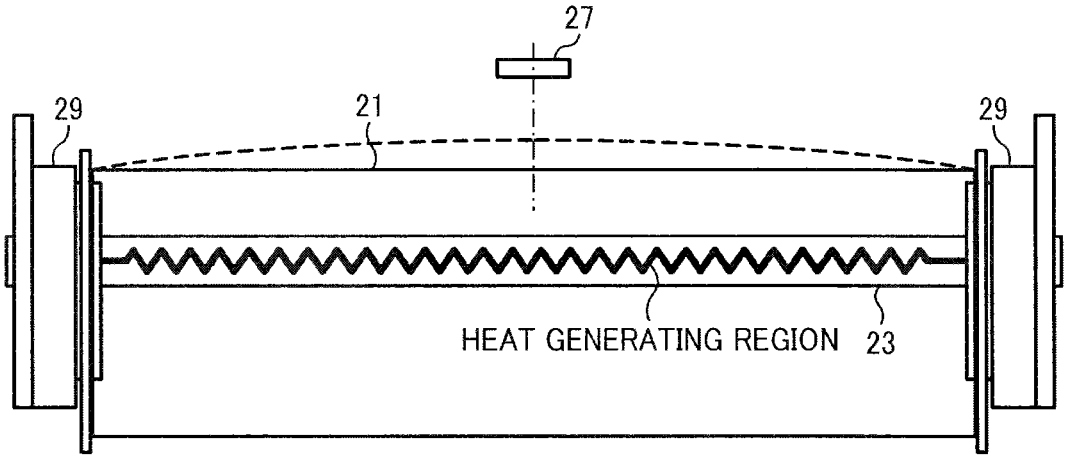
FIG. 6A is a schematic diagram illustrating a fixing belt and a heater according to a first illustrative embodiment.
Figure 7A:
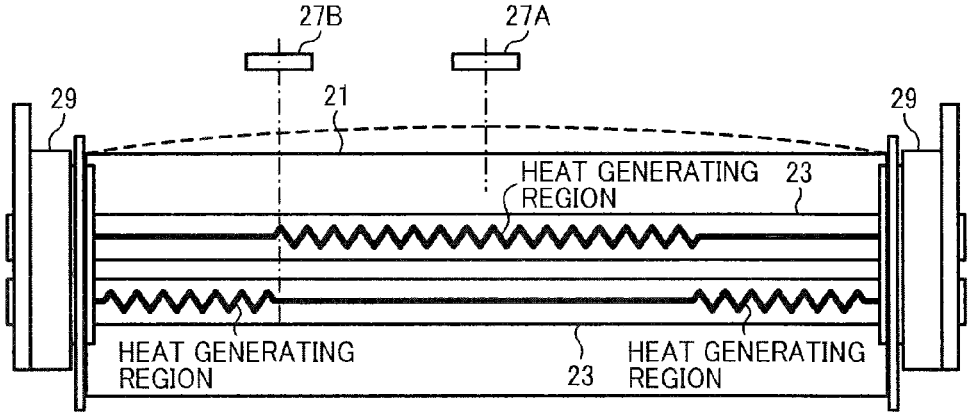
FIG. 7A is a schematic diagram illustrating a fixing belt and a plurality of heaters according to a second illustrative embodiment.

Next, a description is provided of deformation of the fixing belt 21 in the longitudinal direction thereof (the axial direction of the pressing roller 22). As illustrated in FIGS. 6A and 7A, the flange 29 is disposed at each end of the fixing belt 21. In other words, the fixing belt 21 is disposed between the flanges 29. Therefore, when the fixing belt 21 expands due to heat, although the slip ring 41 is disposed between the flange 29 and each end of the fixing belt 21, each end of the fixing belt 21 in the axial direction thereof is pressed or regulated by the flange 29 and thus the fixing belt 21 deforms or expands as indicated by a broken line. Deformation of the substantially center of the fixing belt 21 in the axial direction or the longitudinal direction is the largest.

In view of the above, the temperature detector 27 is disposed facing the center of the cylinder-shaped endless fixing belt 21 in the axial (longitudinal) direction thereof. Similar to the first illustrative embodiment, in the second illustrative embodiment, a first temperature detector 27A is disposed facing the center of the fixing belt 21 in the axial (longitudinal) direction thereof. Furthermore, in the second illustrative embodiment, the fixing device 20 includes a second temperature detector 27B in addition to the first temperature detector 27A.

As described above, deformation near the center of the fixing belt 21 in the axial (longitudinal) direction thereof is the largest. Thus, the temperature detector 27 (27A) is provided to the place corresponding to near the center of the fixing belt 21. With this configuration, even when the fixing belt 21 deforms, the angle and the positional relations of the fixing belt 21 relative to the temperature detector 27 (27A) do not easily change, thereby maintaining detection accuracy of the temperature detector 27 (27A).

Heat from both ends tends to be concentrated near the center of the fixing belt 21 in the axial/longitudinal direction, and hence the temperature of the fixing sleeve rises easily. That is, the heat from the halogen heater 23 is concentrated near the center of the fixing belt 21 in the longitudinal direction. In other words, the heat is concentrated in the direction perpendicular to the sheet transport direction. The place on which the heat is concentrated is referred to as a heat concentration area indicated by a two-way arrow in FIGS. 6B and 7B. Therefore, the temperature detector 27 (27A) is provided to the place corresponding to the heat concentration area of the fixing belt 21. In particular, since the center of the fixing belt 21 in the longitudinal direction deforms the most or deforms easily, the temperature detector 27 (27A) is provided to the place corresponding to the center of the fixing belt 21 in the longitudinal direction (perpendicular to the sheet transport direction).

Next, a description is provided of concentration of heat from the halogen heater 23 in the circumferential direction of the fixing belt 21 (the radius direction of the cross section of the fixing belt).

Figure 6B:
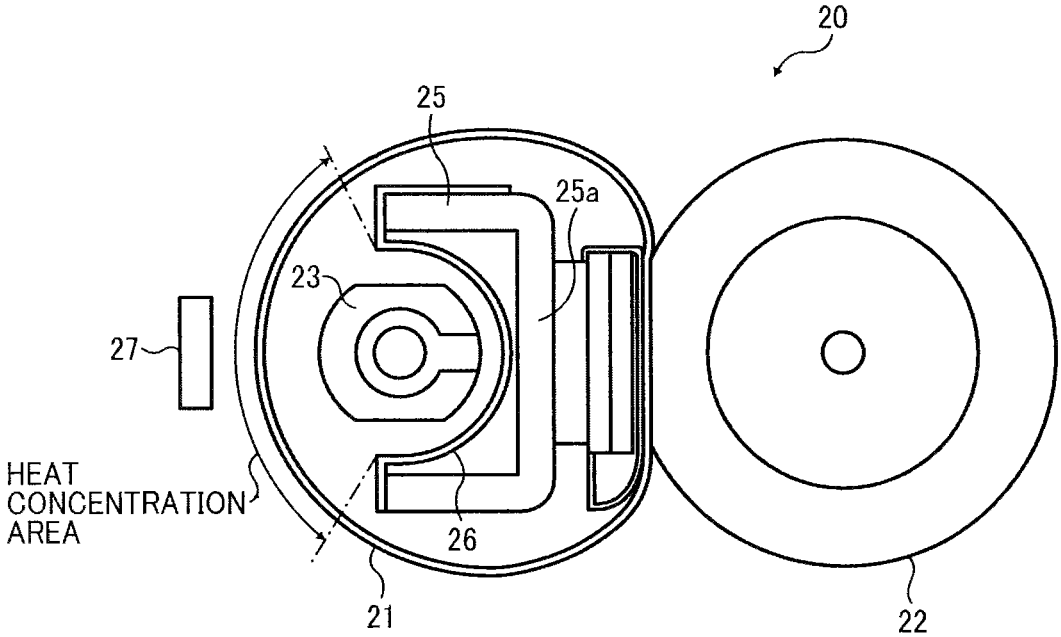
FIG. 6B is a cross-sectional view schematically illustrating a fixing device including the fixing belt and the heater of FIG. 6A according to the first illustrative embodiment.
Figure 7B:
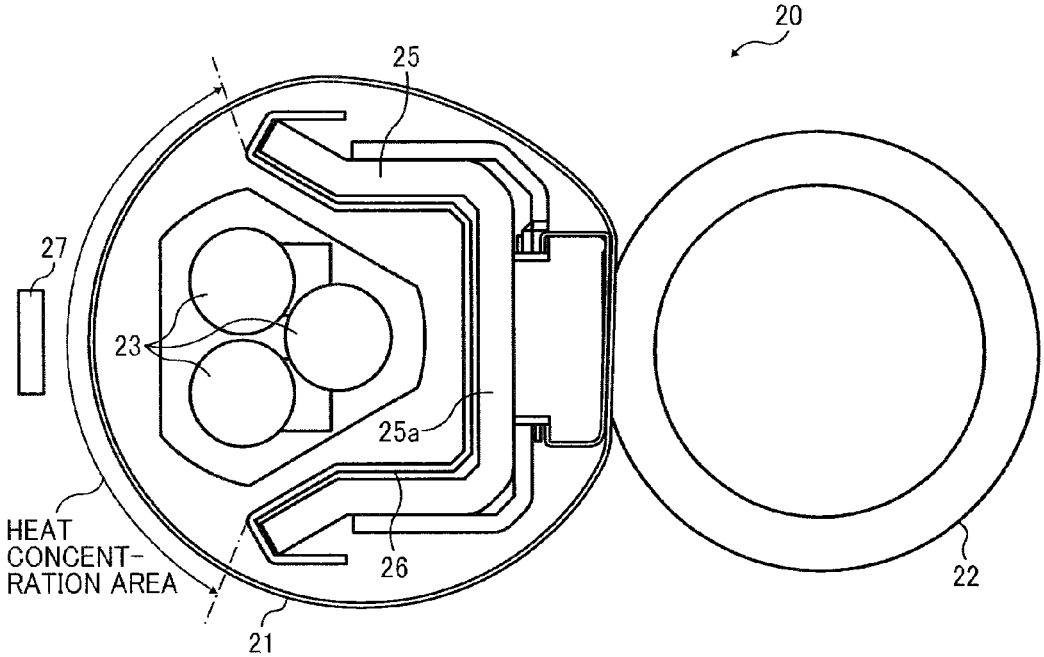
FIG. 7B is a cross-sectional view schematically illustrating a fixing device including the fixing belt and the heaters of FIG. 7A according to the second illustrative embodiment.

According to the illustrative embodiments as described above, the fixing device 20 includes the reflective member 26 to enhance heating efficiency. In this configuration, the heat from the halogen heater 23 is reflected by the reflective member 26 and concentrated onto a heating area of the fixing belt 21 which is referred to as the heat concentration area indicated by the two-way arrow in FIGS. 6B and 7B. Therefore, the temperature detector 27 is provided to the place within the heat concentration area of the fixing belt 21 indicated by the two-way arrow in FIGS. 6B and 7B. In particular, since the center of the heat concentration area of the fixing belt 21 is heated the most, the temperature detector 27 is provided to the place as illustrated in FIGS. 6B and 7B.

It is to be noted that instead of using the reflective member 26, alternatively, the stay 25 may have a reflective surface to reflect the heat from the halogen heater 23. As the temperature detector 27 (27A and 27B in the second illustrative embodiment) is disposed within the heat concentration area, even when the fixing belt 21 deforms, the fixing belt 21 deforms towards the temperature detector 27 (27A and 27B), thereby preventing the temperature detection accuracy from decreasing. Furthermore, as the temperature detector 27 (27A and 27B in the second illustrative embodiment) is disposed at a place corresponding to the substantially center of heat concentration area which is heated the most, the temperature change of the fixing belt 21 can be detected more reliably.

According to the second illustrative embodiment, the second temperature detector 27B includes the plurality of heat sources (i.e., the heaters 23). The heat generating (light emitting) regions of the heaters 23 are formed at different locations. The temperature of a joining portion at which the heat generating (light emitting) regions of different heaters 23 are adjacent to one another, or the heat generating regions overlapping each other is high. For this reason, according to the second illustrative embodiment, the second temperature detector 27B is disposed at a place corresponding to the joining portion of the heat generating regions or the heat generating regions overlapping each other. Accordingly, the temperature of the portion of the fixing belt 21 where the temperature rises high easily is detected reliably.

According to the illustrative embodiments as described above, the halogen heater 23 is disposed so as to correspond to the substantially center of the nip portion N in the sheet transport direction (a perpendicular line Z drawn from the substantially center of the nip portion N in the sheet transport direction in FIGS. 2 and 5, that is, on a horizontal line in FIGS. 2 and 5). Furthermore, the reflective member 26 has symmetry about a vertical line (i.e., the perpendicular line Z described above). It is to be noted that in FIGS. 2 and 5 the reflective member 26 has symmetry about a horizontal line. The place of the fixing belt 21 that deforms the most or deforms easily in the circumferential direction is near or on the perpendicular line Z described above. Thus, the temperature detector 27 is disposed near or on the perpendicular line Z.

Figure 8:
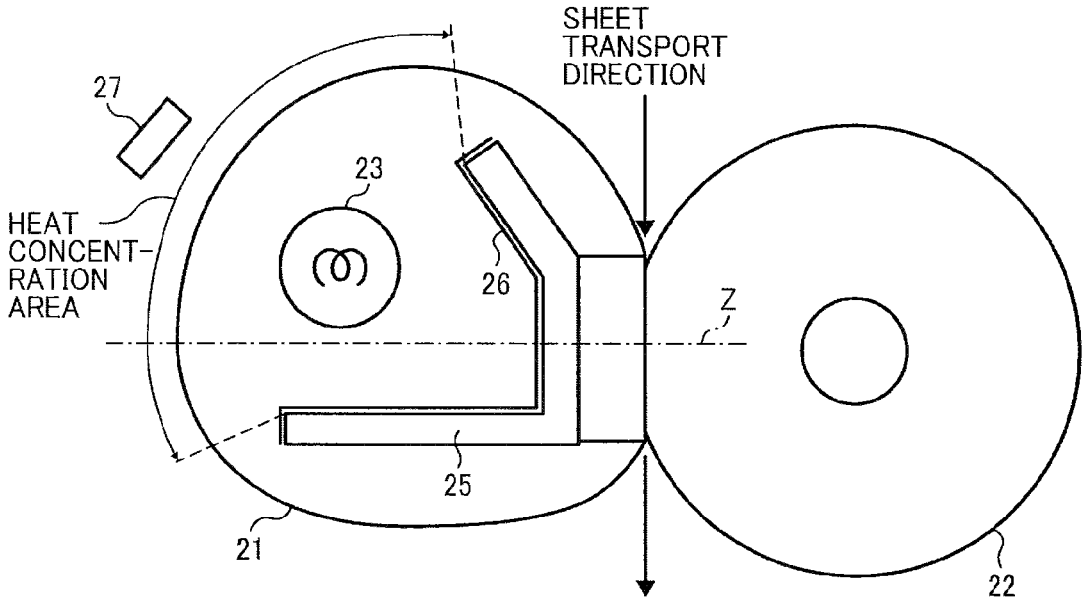
FIG. 8 is a schematic diagram illustrating a variation of the fixing device.
Figure 9:
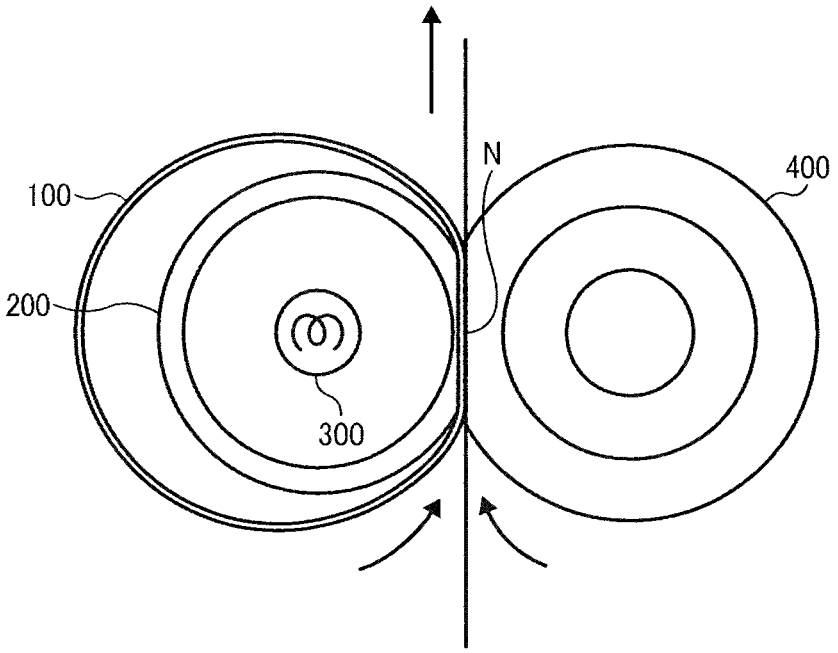
FIG. 9 RELATED ART
FIG. 9 is a cross-sectional view schematically illustrating a related-art fixing device.
Figure 10:
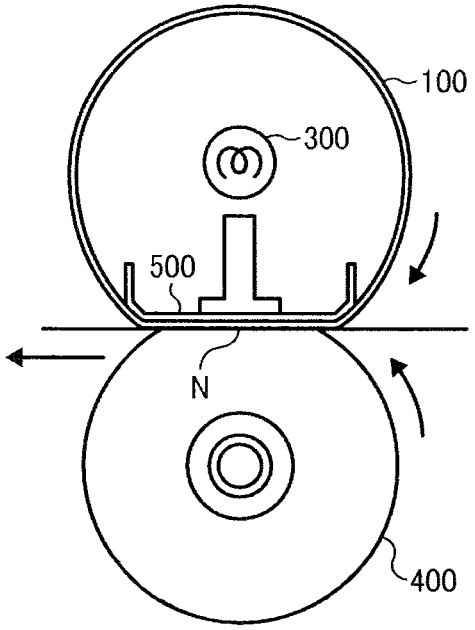
FIG. 10 RELATED ART
FIG. 10 is a cross-sectional view schematically illustrating another example of the related-art fixing device.

However, in configurations in which the heat source is disposed at a different place and/or the shape of the reflective member is not symmetrical, a different place of the fixing belt 21 other than the substantially center of the nip portion N in the circumferential direction of the belt may deform the most or deform easily. In such a case, the temperature detector may be disposed at a place corresponding to the place of the fixing belt 21 that deforms the most or deforms easily depending on the location of the heat source and the shape of the reflective member. Referring now to FIG. 8, there is provided a cross sectional view schematically illustrating a variation of the fixing device which accommodates such a demand.

In FIG. 8, the heat source 23 is disposed offset from the perpendicular line Z from the nip center. The reflective member 26 does not have symmetry. As a result, the heat concentration area is off from the center of the nip portion. In this configuration, the temperature detector 27 is disposed within the heat concentration area in the circumferential direction of the fixing belt 21 (in the radius direction of the fixing belt 21 in the cross section perpendicular to the shaft of the pressing roller 22), preferably, at the center of the heat concentration area in the belt circumferential direction. With this configuration, the temperature of the fixing belt 21 can be detected properly at the place corresponding to the place of the fixing belt 21 that deforms the most or deforms easily.

According to the illustrative embodiments, the temperature detector is disposed at a place corresponding to the place of the fixing belt that deforms the most or deforms easily. The place at which the temperature detector is disposed may vary depending on a configuration of the apparatus.

Next, with reference to FIG. 1, a description is provided of a color laser printer as an example of the image forming apparatus 1 according to an illustrative embodiment of the present invention.

An image forming apparatus 1 illustrated in FIG. 1 is an example of a color laser printer, and at the middle of the main body, four image forming units 4Y, 4M, 4C, and 4K are disposed. The respective image forming units 4Y, 4M, 4C, and 4K all have the same configurations as all the others, except for developers of different colors: yellow (Y); magenta (M); cyan (C); and black (K), which correspond to color separation components of a color image. It is to be noted that reference characters Y, M, C, and K denote the colors yellow, magenta, cyan, and black, respectively. To simplify the description, the reference characters Y, M, C, and K indicating colors are omitted herein unless otherwise specified.

More specifically, each of the image forming units 4Y, 4M, 4C, and 4K is provided with a drum-shaped photosensitive member (hereinafter referred to as a photosensitive drum) 5 as a latent image bearing member, a charging unit 6 that charges the surface of the photosensitive drum 5, a development unit 7 that supplies toner to the surface of the photosensitive drum 5, a cleaning unit 8 that cleans the surface of the photosensitive drum 5, and the like.

It is to be noted that in FIG. 1, reference numbers are provided only to the photosensitive drum 5, the charging unit 6, the development unit 7, and the cleaning unit 8 included in the black image forming unit 4K, and the reference numbers are omitted for the other image forming units 4Y, 4M, and 4C.

Below the image forming units 4Y, 4M, 4C, and 4K, an exposure unit 9 that exposes the surface of the photosensitive drum 5 is disposed. The exposure unit 9 has a light source, a polygon mirror, an f-θ lens, a reflective mirror, and so forth, and illuminates the surface of each photosensitive drum 5 with laser light based on image data.

A transfer unit 3 is disposed substantially above the image forming stations 4Y, 4M, 4C, and 4K. The transfer unit 3 includes an intermediate transfer belt 30 serving as a transfer body, four primary transfer rollers 31 serving as a primary transfer mechanism, a secondary transfer roller 36 serving as a secondary transfer mechanism, a secondary transfer backup roller 32, a cleaning backup roller 33, a tension roller 34, and a belt cleaning unit 35.

The intermediate transfer belt 30 is a belt formed into a loop and entrained about the secondary transfer backup roller 32, the cleaning backup roller 33, and the tension roller 34. Herein, rotation of the secondary transfer backup roller 32 causes the intermediate transfer belt 30 to move or rotate in a direction indicated by an arrow in FIG. 1.

The intermediate transfer belt 30 is interposed between each of the four primary transfer rollers 31 and the photosensitive drums 5, thereby forming primary transfer nips therebetween. Furthermore, each primary transfer roller 31 is connected to a power source, not illustrated, and a predetermined direct current (DC) voltage and/or an alternating current (AC) voltage are supplied to each primary transfer roller 31.

The intermediate transfer belt 30 is interposed between the secondary transfer roller 36 and the secondary transfer backup roller 32, thereby forming a secondary transfer nip therebetween. Moreover, similar to the primary transfer roller 31, the secondary transfer roller 36 is also connected to a power source, not illustrated, and a predetermined direct current voltage (DC) and/or an alternating current (AC) voltage are supplied to the secondary transfer roller 36.

The belt cleaning unit 35 includes a cleaning brush and a cleaning blade which are disposed so as to be in contact with the intermediate transfer belt 30. A waste toner transferring tube, not illustrated, extending from the belt cleaning unit 35 is connected to an inlet section of the waste toner housing, not illustrated.

In the upper part of the main body, a bottle housing unit 2 is provided, and four toner bottles 2Y, 2M, 2C, and 2K that house supplemental toner are detachably mounted in the bottle housing unit 2. A supply path, not illustrated, is provided between each of the toner bottles 2Y, 2M, 2C, and 2K, and each of the developing units 7, and toner is supplied from each of the toner bottles 2Y, 2M, 2C, and 2K to each of the respective developing units 7 via the supply path.

Meanwhile, in the lower part of the main body, there are provided a sheet cassette 10 that houses multiple recording media sheets P and a sheet feed roller 11 that picks up the recording medium P out of the sheet cassette 10. According to the present illustrative embodiment, other than ordinary paper, the record medium includes cardboard, a postcard, an envelope, thin paper, applied paper (coated paper, art paper, etc.), tracing paper, an OHP sheet, and the like. Although not illustrated, a manual sheet feed system may be provided.

Inside the main body, a sheet delivery path R is disposed to deliver the recording medium P from the sheet cassette 10 to pass through the secondary transfer nip and ejects the paper to the outside of the apparatus. Upstream from the secondary transfer roller 36 in the sheet delivery path R in the sheet transport direction, there is provided a pair of registration rollers 12 serving as a delivery mechanism to deliver the recording medium P to the secondary transfer nip.

Downstream from the secondary transfer roller 36 in the sheet transport direction, there is provided a fixing device 20 for fixing an unfixed image transferred to the recording medium P. Moreover, downstream from the fixing device 20 in the sheet delivery path R in the sheet transport direction, there is provided a pair of sheet output rollers 13 for ejecting the recording medium P to the outside of the image forming apparatus 1. Furthermore, on the upper surface section of the main body, the output sheet tray 14 for holding in stock the recording medium ejected to the outside of the image forming apparatus 1.

Still referring to FIG. 1, basic operations of the image forming apparatus according to the present illustrative embodiment is described.

Upon start of an image forming operation, each photosensitive drum 5 in each of the image forming units 4Y, 4M, 4C, and 4K is rotated in a clockwise direction by a driving unit, not illustrated, in FIG. 1, and the surface of each photosensitive drum 5 is uniformly charged by the charging unit 6 to a predetermined polarity. The charged surface of each photosensitive drum 5 is illuminated with laser light projected from the exposure unit 9, to form an electrostatic latent image on the surface of each photosensitive drum 5. At this time, the image information exposed to each photosensitive drum 5 includes image information decomposed into yellow, magenta, cyan and black color information. In such a manner, toner is supplied by each developing unit 7 to the electrostatic latent image formed on each photosensitive drum 5, thereby forming the electrostatic latent image into a visible image, also known as a toner image.

Furthermore, upon start of the image forming operation, the secondary transfer backup roller 32 is rotated in the counterclockwise direction in FIG. 1, to move the intermediate transfer belt 30 in the direction indicated by the arrow. Then, each primary transfer roller 31 is supplied with a constant-voltage controlled or constant-current controlled voltage having the polarity opposite that of the charged toner. Accordingly, a transfer electric field is formed in the primary transfer nip between each primary transfer roller 31 and each photosensitive drum 5.

When toner images of each color formed on the photosensitive drums 5 arrive at the primary transfer nip in association with rotation of the photosensitive drums 5, the toner images on the photosensitive drums 5 are sequentially transferred onto the intermediate transfer belt 30 due to the transfer electric field formed in the primary transfer nips, such that they are superimposed one atop the other, thereby forming a composite toner image on the surface of the intermediate transfer belt 30. After transfer of the toner image, toner remaining on each photosensitive drum 5 which was not transferred to the intermediate transfer belt 30 is removed by the cleaning unit 8. Remaining charge on each surface of the photosensitive drum 5 is then removed by a charge neutralizer, not illustrated, to initialize a surface potential.

In the lower part of the image forming apparatus, the sheet feed roller 11 starts to rotate, and the recording medium P is fed from the sheet cassette 10 to the sheet delivery path R. The recording medium P fed to the sheet delivery path R is delivered to the secondary transfer nip between the secondary transfer roller 36 and the secondary transfer backup roller 32 at an appropriate timing adjusted by the pair of registration rollers 12. At this time, the secondary transfer roller 36 has been supplied with a transfer voltage having the opposite polarity to the charge polarity of the composite toner image on the intermediate transfer belt 30, thereby forming a transfer electric field in the secondary transfer nip.

When the composite toner image on the intermediate transfer belt 30 then reaches the secondary transfer nip as the intermediate transfer belt 30 rotates, the composite toner image on the intermediate transfer belt 30 is transferred onto the recording medium P by the transfer electric field formed in the secondary transfer nip. Furthermore, at this time, the residual toner remaining on the intermediate transfer belt 30 which has not been transferred to the recording medium P is removed by the belt cleaning unit 35, and the removed toner is delivered and collected to a waste toner bin, not illustrated.

Subsequently, the recording medium P is delivered to the fixing device 20, and the toner image transferred on the recording medium P is fixed to the recording medium P by the fixing device 20. After fixation, the recording medium P is then output outside of the apparatus by the sheet output rollers 13 and stacked on the output sheet tray 14.

The above description pertains to image forming operations for a color image. It is also possible to form a monochrome image using any one of the four image forming units 4Y, 4M, 4C, and 4K, or to form an image of two or three colors by using two or three image forming units.

Although the embodiment of the present invention has been described above, the present invention is not limited to the foregoing embodiments, but various modifications can be made within the scope of the present invention. For example, the number of heat sources and the place at which the heat source is disposed may be varied within the scope of the present invention. Furthermore, the heat source is not limited to the halogen heater, but may employ any other suitable heat sources. The shape and the size of the reflective member may be determined arbitrarily. Material for the fixing belt (including film) and the configuration of the pressing member may be varied within the scope of the present invention. The temperature detector may employ any other suitable detectors such as a thermopile and a thermistor.

According to an aspect of this disclosure, the present invention is employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A fixing device for fixing an unfixed image onto a recording medium, comprising:

a fixing belt formed into a loop to move endlessly;

a nip forming member disposed inside the loop formed by the fixing belt;

an opposing rotary member to contact the nip forming member via the fixing belt to form a nip portion therebetween while rotating;

a heater to heat the fixing belt such that the fixing belt is heated at a place other than the nip portion;

a support including a base portion and two arms that extend away from the base portion, the support disposed between the nip forming member and the heater;

a reflector positioned between the heater and the support to reflect the heat from the heater, a portion of the reflector extending along an outer surface of the support; and a temperature detector to detect a temperature of the surface of the fixing belt without contacting the fixing belt so as to allow deformation of the fixing belt, wherein the temperature detector detects the temperature near a place of the fixing belt that easily deforms as the fixing belt is heated by the heater, wherein the reflector covers the support without surrounding an entirety of the support and a concave portion of the reflector extends between the two arms, and wherein a first portion of the heater is positioned to be directly between the two arms and within the concave portion of the reflector, and a second portion of the heater is positioned to be outside of the two arms and the reflector.

2. The fixing device according to claim 1, wherein the temperature detector is disposed at a place corresponding to a heat concentration area of the fixing belt at which heat from the heater is concentrated.

3. The fixing device according to claim 2, wherein the temperature detector is disposed at a place corresponding to a location with a highest heat concentration in the heat concentration area.

4. The fixing device according to claim 2, wherein the reflector reflects the heat towards the heat concentration area.

5. The fixing device according to claim 2, wherein the heat concentration area of the fixing belt is within a cross-section of the fixing belt perpendicular to a shaft of the opposing rotary member.

6. The fixing device according to claim 2, wherein the heat concentration area of the fixing belt is located in a direction perpendicular to a sheet transport direction.

7. The fixing device according to claim 1, further comprising a plurality of heaters, wherein respective heat generating regions of the plurality of heaters are different from one another, and the temperature detector is disposed at a place corresponding to a joining place at which the heat generating regions are adjacent to each other.

8. The fixing device according to claim 1, further comprising a plurality of heaters, wherein respective heat generating regions of the plurality of heaters are different from one another, and the temperature detector is disposed at a place corresponding to a place at which the heat generating regions overlap.

9. An image forming apparatus, comprising the fixing device of claim 1.

* * * * *